United States Patent [19]

Clerbois et al.

[11] 4,372,813

[45] Feb. 8, 1983

[54] PROCESS FOR INHIBITING THE CORROSION OF EQUIPMENT MADE OF TITANIUM

[75] Inventors: Lucien Clerbois; Lucien Plumet, both of Vilvoorde, Belgium

[73] Assignee: Interox (Société Anonyme), Brussels, Belgium

[21] Appl. No.: 236,822

[22] Filed: Feb. 20, 1981

[30] Foreign Application Priority Data

Feb. 21, 1980 [FR] France ..... 80 03890

[51] Int. Cl.[3] ..... D21C 7/00; C11D 7/54; C23F 11/18

[52] U.S. Cl. ..... 162/48; 162/78; 252/186.26; 252/186.27; 252/186.28; 252/186.29; 252/186.32; 252/387; 252/389 R; 422/14

[58] Field of Search ..... 252/186, 387, 389 R; 162/48, 78; 422/14

[56] References Cited

U.S. PATENT DOCUMENTS

| | | | |
|---|---|---|---|
| 2,037,566 | 4/1936 | Durgin | 87/5 |
| 2,303,397 | 12/1942 | Schwartz | 252/135 |
| 2,938,825 | 5/1960 | Richter | 162/48 |

FOREIGN PATENT DOCUMENTS

| | | |
|---|---|---|
| 2342365 | 1/1980 | France . |
| 43277 | 1/1938 | Netherlands . |
| 1045428 | 12/1966 | United Kingdom . |

OTHER PUBLICATIONS

Sigalovskaya et al., Zashohita Metallor, 1976, vol. 12, pp. 331–335.

Clerbois, Rapport Technique, 1973, (122), 209.1.

*Primary Examiner*—Irwin Gluck

*Attorney, Agent, or Firm*—Spencer & Kaye

[57] ABSTRACT

Process for inhibiting the corrosion of equipment made of titanium or of alloys containing titanium by a solution containing a peroxy compound. To effect the inhibition, a solution containing calcium, strontium or barium ions is used.

10 Claims, No Drawings

PROCESS FOR INHIBITING THE CORROSION OF EQUIPMENT MADE OF TITANIUM

BACKGROUND OF THE INVENTION

The present invention relates to a process for inhibiting the corrosion of equipment made of titanium or of alloys containing titanium by aqueous solutions containing a peroxy compound and more particularly, by alkaline aqueous solutions containing a peroxy compound such as hydrogen peroxide.

Titanium and its alloys are materials frequently used in the manufacture of equipment for industrial installations for bleaching of cellulose materials. These installations often include multi-purpose apparatus in which various kinds of widely differing reagents can be used. This is the case for example, in textile bleaching installations, in dynamic paper pulp bleaching installations, and in certain conventional kraft pulp bleaching installations, which include an all-purpose final stage. Equipment in such installations is made at least in part of titanium or one of its alloys.

Since titanium and its alloys can be corroded by certain aqueous solutions commonly used in bleaching, such as alkaline aqueous solutions of peroxy compounds, the choice of reagents or the concentration at which they should be used in installations having surfaces which are in contact with such solutions, and which are made of titanium or one of its alloys, is limited.

To inhibit the corrosion of titanium under these conditions, the suggestion has been made (T. M. Sigalovskaya, et al. Zashchita Metallov, 1976 Vol. 12 (4), P363–367) that sodium hexametaphosphate or sodium silicate be added to the corrosive solution. However, the reduction in corrosion observed is insufficient for the process to be applied industrially.

SUMMARY OF THE INVENTION

The present invention has the aim of making it possible to use aqueous solutions containing a peroxy compound in equipment made of titanium or of alloys containing titanium for example, in bleaching installations.

Moreover, the process according to the invention has the advantage, when it is applied in installations used for the bleaching of cellulose materials, of considerably improving the bleaching effect. In the case of paper pulp production it also makes it possible to obtain very good yields.

To this end, the invention relates to a process for inhibiting the corrosion of equipment made of titanium, or of alloys containing titanium, by aqueous solutions containing a peroxy compound according to which a solution containing calcium, strontium or barium ions is used.

DETAILED DESCRIPTION OF THE INVENTION

The alkaline earth metal ions can be supplied to the solution in the form of various types of compounds. In general, compounds are used which are soluble in the solution at the concentrations used; soluble organic or inorganic compounds can be used. Preferably, the acetates, nitrates, hydroxides, sulphates, chlorates, hypochlorites or halides such as chlorides are used. The best results have been obtained with the acetates, carbonates and bicarbonates, nitrates, sulphates and chlorides. Mixtures of these compounds as well as mixtures of ions can also be used. Where calcium ions are being used, hard water can advantageously be used to constitute the solution by adjusting the level of ions where necessary to the value required by addition of ions.

The quantity of ions used in the solution is, in general, between 0.0001 and 0.5 gramme atoms per liter of solution. A solution containing ions in a quantity of between 0.001 and 0.1 gramme atoms per liter is preferably used.

The process according to the invention can be used to inhibit the corrosion of titanium or alloys containing titanium in contact with solutions of various compositions. It is used in general to inhibit corrosion by aqueous solutions containing one or more peroxy compounds or organic or inorganic nature. The invention can therefore be applied to the inhibition of corrosion by solutions containing organic peroxides, such as the peracids and their salts as well as the corresponding acyl peroxides. It is applied notably to the inhibition of corrosion by solutions of aliphatic peracids, such as peracetic acid, perpropionic acid and perbutyric acid, and of their salts.

The invention is advantageously applied to the inhibition of corrosion by solutions containing inorganic peroxy compounds such as hydrogen peroxide and the peroxides and persalts of alkali metals. The process according to the invention is particularly suitable for inhibiting corrosion by solutions containing hydrogen peroxide or alkali metal peroxides, and more particularly, sodium and potassium peroxides.

The concentration of peroxy compounds in the solution is variable and depends on the use for which the latter is intended. In general, this concentration is between 0.1 and 100 g/l.

The process according to the invention is particularly suited to inhibiting corrosion by alkaline solutions. These can be made alkaline directly by the peroxy compound where it is itself of a basic character, or by the presence of one or more compounds of a basic character. The pH of these alkaline solutions is in general greater than 8 and most often between 8.5 and 13.

The compounds responsible for the alkalinity of the corrosive solutions may be of various kinds. Most often, they are silicates, phosphates, carbonates, borates or hydroxides of ammonium and of alkali metals, more particularly of sodium and potassium. Obviously, other compounds of a basic character may also be present. The process according to the invention is particularly suited to inhibiting corrosion by solutions containing a hydroxide of alkali metal, more particularly, of sodium and of potassium.

The concentration of compounds of a basic character is variable and depends on the use for which the solution is intended. In general, it is between 0 and 100 g/l, and most often between 1 and 100 g/l.

Excellent results have been obtained by applying the process according to the invention to the inhibition of corrosion by solutions containing a sodium or potassium peroxide or solutions containing hydrogen peroxide and a sodium or potassium hydroxide.

The solutions of peroxy compounds may also contain other substances chosen as a function of the special field of application of these solutions. They may therefore contain stabilisers of peroxy compounds, activators of peroxy compounds, pH regulating agents, etc.

The temperatures at which titanium or its alloys are subjected to the action of corrosive solutions are variable. In general, they are between 0° and 230° C.

The process according to the invention is suited to the inhibition of corrosion of equipment consisting entirely or partially of titanium or of alloys containing titanium of widely varying kinds. In general, the surfaces in contact with the solutions consist of 80 to 100% titanium and 0 to 20% of elements such as aluminium, chromium, iron, tantalum, molybdenum tin, vanadium, niobium, palladium, carbon, nitrogen or hydrogen.

The process according to the invention may thus be applied to various commercial grades of "pure" titanium, such as grades, Ti35A, Ti50A, Ti65A and Ti75A and to various alloys such as Ti-140A, Ti-155A, Ti-0.20Pd, Ti-5Al-2.5Sn, Ti-6Al-4V, Ti-7Al-2Nb-1Ta, Ti-8Al-1Mo-1V, Ti-6Al-4V-1Sn, Ti-6Al-6V-2.5Sn, Ti-6Al-2-Mo, Ti-7Al-3Mo, Ti-4Al-3Mo-1V, Ti-0.15Pd and Ti-0.3Mo-0.8Ni.

The process according to the invention is suited to various operations in which aqueous solutions of peroxy compounds are used. It may therefore be used advantageously in the bleaching of cellulose materials and in particular in the bleaching of textiles, fibres and virgin paper pulps or pulps obtained during a process for recycling waste papers. The process according to the invention is thus advantageously used in the bleaching of mechanical, chemical and semi-chemical, chemi-mechanical and thermomechanical paper pulps. Good results have been obtained by applying the process according to the invention to dynamic bleaching techniques.

For this particular use, the solution can contain, in addition to the peroxy compound which is preferably hydrogen peroxide or sodium peroxide and water, a base, where the peroxy compound chosen is hydrogen peroxide, chosen from potassium hydroxide and sodium hydroxide, the latter being preferred, as well as certain additives such as sequestering agents and stabilisers of peroxy compounds.

The temperatures at which the dynamic bleaching of paper pulps is carried out are variable. They are in general between 20° and 130° C., and preferably between 25° and 100° C. The bleaching time can vary within broad limits: it is in general, between 0.5 and 100 minutes. The consistencies of the pulps are in general between 0.1 and 25%.

The reagents are usually present in the solutions in concentrations of 0.1 to 20% by weight of peroxy compound respectively, from 0 to 20% by weight of a compound of basic character (when the peroxy compound is not of basic character, this level is usually between 0.1 and 20%) and from 0 to 5%, more particularly from 0.01 to 5%, of various additives with respect to the weight of the dry pulp. The following can be used as additives suitable for the stabilisation of peroxy compounds: polymers derived from an alpha-hydroxy-acrylic acid described in French Pat. No. 2 342 365—filed on Feb. 21, 1977 in the name of SOLVAY & Cie, their salts and their derivatives or alkylidene-polyphosphonic acids and their derivatives such as the aminotri(methylenephosphonic), 1-hydroxy-ethylidene-1,1-diphosphonic, ethylenediaminotetra(methylenephosphonic), hexamethylenediaminotetra(methylenephosphonic) and diethylenetriaminopenta(methylenephosphonic) acids as well as their salts.

In order to illustrate the invention without however limiting its scope, we give below some examples showing the effectiveness of the process according to the invention (examples 1 to 23) and showing the compatibility of the ions with the paper pulp bleaching media (examples 24 to 38).

EXAMPLES 1 TO 23

Three cylindrical electrodes made from CONTIMET 30 titanium 9 mm in diameter and 53 mm high, and two examples of the same material 50 mm high, 20 mm wide and 2 mm thick were places horizontally in a thermostatically controlled container of approximately 200 $cm^3$ fitted with an overflow device. The electrodes and samples had been pickled beforehand by means of an aqueous solution containing 122 $cm^3$ of concentrated nitric acid per liter and 46 g of sodium fluoride per liter, and then passivated with 10% nitric acid.

The container was continuously supplied with a 30% aqueous solution of hydrogen peroxide with a flow rate of 50 $cm^3$/hour and an alkaline aqueous solution whose composition is given in Table I with a flow rate of 3.6 l/hour. For example 22, the alkaline solution was town water of hardness 29.5 French degrees. The two solutions were mixed in contact with the samples and electrodes. The overflow was recovered in a thermostatically controlled tank. The temperature of the container and of the tank was 80° C.

The solutions used contained, as sequestering agent, either sodium poly-alpha-hydroxyacrylate sold under the trade name CLARENE by SOLVAY & Cie, of S grade, or diethylene-triamine-penta (sodium methylenephosphonate) sold by MONSANTO under the trade name DEQUEST, of grade 2066.

The pH of the solution was monitored by a pH-meter placed in the container. The hydrogen peroxide content in the tank was determined at the beginning and at the end of the experiment.

The polarisation resistance was measured continuously by means of the electrodes. The corresponding weight loss was calculated according to the method described in the article by L. Clerbois, Centre Belge de l'Etude de la Corrosion, Rapport Technique, 1973, 122, 209.1.

The weight of the samples was monitored before and after each test and the weight loss by direct measurement was expressed in mm/annum (1 mm/annum corresponds to 12.5 g per day and per $m^2$ of surface area).

The operating conditions and results obtained are shown in Table I below. Tests 1 to 6 were carried out by way of comparison.

TABLE I

| Example No | NaOH g/l | Sequestering Agent g/l * | Sequestering Agent Brand name and grade | Inhibitor g/l | Inhibitor Type | $H_2O_2$ g/l Beginning | $H_2O_2$ g/l End | time hours | pH | weight loss by measurement of polarisation resistance mean mm/year | weight loss by measurement of polarisation resistance inhibition % | weight loss by direct measurement sample 1 mm/year | weight loss by direct measurement sample 2 mm/year | weight loss by direct measurement inhibition % |
|---|---|---|---|---|---|---|---|---|---|---|---|---|---|---|
| 1 | 2 | 1 | Clarene S | — | — | 4.1 | 4.1 | 1 | 10.4 | 19.1 | 0 | 31.4 | 32 | 0 |
| 2 | 2 | 1 | Clarene S | 1 | $(NaPO_3)_6$ | 4.0 | 4.0 | 1 | 10.4 | 11.6 | 39.3 | 11.0 | 10.8 | 65.6 |

TABLE I-continued

| Example No | NaOH g/l | Sequestering Agent g/l * | Sequestering Agent Brand name and grade | Inhibitor g/l | Inhibitor Type | $H_2O_2$ g/l Beginning | $H_2O_2$ g/l End | time hours | pH | weight loss by measurement of polarisation resistance mean mm/year | weight loss by measurement of polarisation resistance inhibition % | weight loss by direct measurement sample 1 mm/year | weight loss by direct measurement sample 2 mm/year | weight loss by direct measurement inhibition % |
|---|---|---|---|---|---|---|---|---|---|---|---|---|---|---|
| 3 | 2 | 1 | Clarene S | 2 | Na silicate | 4.0 | 4.0 | 1 | 10 | 9.1 | 52.3 | 7.8 | 6.9 | 76.8 |
| 4 | 2 | 1 | Clarene S | 1<br>1 | $(NaPO_3)_6$<br>Na silicate | 3.6 | 3.7 | 1 | 10.3 | 8.6 | 55.5 | 7.6 | 7.7 | 75.9 |
| 5 | 2 | 1 | Clarene S | 1 | $MgCl_2$ | 3.4 | 4.4 | 1 | 10.1 | 9.2 | 51.8 | 11.2 | 10.8 | 65.3 |
| 6 | 2 | 1 | Clarene S | 1 | $MgSO_4$ | 3.9 | 4.4 | 1 | 10 | 7.2 | 62.3 | 7.3 | 7.8 | 76.2 |
| 7 | 2 | 1 | Clarene S | 1 | $(CH_3COO)_2Ba$ | 4.8 | 4.1 | 1 | 10.1 | 0.5 | 97.4 | 0 | 0 | 100 |
| 8 | 2 | 1 | Clarene S | 1 | $BaSO_4$ | 3.4 | 4.6 | 1 | 10.4 | 0.4 | 97.9 | 0.9 | 0.8 | 97.3 |
| 9 | 2 | 1 | Clarene S | 0.14 | $Ba(NO_3)_2$ | 3.8 | 4.1 | 7 | 10.3 | 0.86 | 95.5 | 0.67 | 0.55 | 98.1 |
| 10 | 2 | 1 | Clarene S | 0.7 | $Ba(NO_3)_2$ | 4.1 | 4.1 | 7 | 10.6 | 0.003 | 99.9 | 0 | 0 | 100 |
| 11 | 2 | 1 | Clarene S | 1 | $BaCl_2$ | 2.8 | 3.4 | 1 | 9.8 | 0.006 | 99.9 | 0.4 | 0.4 | 98.7 |
| 12 | 2 | 1 | Clarene S | 1 | $(CH_3COO)_2Sr$ | 3.7 | 4.2 | 1 | 10 | 0.003 | 99.9 | 0 | 0 | 100 |
| 13 | 2 | 1 | Clarene S | 0.7 | $Sr(NO_3)_2$ | 3.8 | 3.8 | 7 | 10.6 | 0.010 | 99.9 | 0 | 0 | 100 |
| 14 | 2 | 1 | Dequest 2066 | 0.7 | $Sr(NO_3)_2$ | 4.2 | 3.5 | 7 | 10.5 | 0.038 | 99.8 | 0.02 | 0 | 99.9 |
| 15 | 2 | 1 | Clarene S | 0.5 | $SrCl_2$ | 3.8 | 4.1 | 7 | 10.6 | 0.002 | 99.9 | 0 | 0 | 100 |
| 16 | 2 | — | — | 1 | $SrCl_2$ | 4.2 | 4.3 | 1 | 10.4 | 0.003 | 99.9 | not measured | | |
| 17 | 2 | 1 | Clarene S | 1 | $(CH_3COO)_2Ca$ | 2.8 | 2.4 | 1 | 10 | 0.5 | 97.4 | 0 | 0 | 100 |
| 18 | 2 | 1 | Clarene S | 1 | $CaSO_4$ | 3.2 | 2.6 | 1 | 10 | 0.5 | 97.4 | gain | | >100 |
| 19 | 2 | 1 | Clarene S | 1 | $Ca(NO_3)_2$ | 3.6 | 3.1 | 1 | 9.9 | 0.3 | 98.4 | 0 | 0 | 100 |
| 20 | 2 | 1 | Clarene S | 1 | $CaCl_2$ | 3.1 | 0.7 | 7 | 10.2 | 0.002 | 99.9 | gain | | >100 |
| 21 | 2 | — | — | 1 | $CaCl_2$ | 3.7 | 3.7 | 1 | 10.5 | 0.003 | 99.9 | not measured | | |
| 22 | 2 | 1 | Clarene S | 0.295 | $CaCO_3$ | 4.1 | 4.1 | 1 | 10.4 | 0.010 | 99.9 | 0 | 0 | 100 |
| 23 | 2 | 1 | Clarene S | 0.2<br>0.5 | $CaCl_2$<br>$MgSO_4$ | 4.3 | 4.6 | 1 | 10.4 | 0.61 | 96.8 | 0 | 0 | 100 |

*expressed as active materials

Examination of the results in Table I shows that the use of ions according to the invention makes it possible to reduce very considerably, or even suppress corrosion, whereas known inhibitors (sodium silicate and sodium hexametaphosphate) are much less effective. Similarly, it can be seen that, when used alone, magnesium ions do not permit sufficient inhibition of corrosion.

EXAMPLES 24 TO 38

Bleaching tests were carried out in a laboratory apparatus suitable for dynamic bleaching on two kraft pulps which had previously been semi-bleached by a conventional CED sequence. The consistency of the pulps was 10% in all cases. The temperature was kept at 70° C. and the operation lasted 10 minutes. The rate of elution of the bleaching solution was 50 $cm^3$/min.

After bleaching, the pulp was acidified and a sample taken for determination of the level of whiteness according to standard ISO 2470.

Two series of tests were carried out. The first series of tests was carried out on a pulp whose original whiteness was 71° ISO.

The operating conditions and results obtained are shown in Table II below. Tests 24 and 28 were carried out in the presence of a titanium mesh. Tests 24 and 25 were carried out by way of comparison.

TABLE II

| Test No. | 24 | 25 | 26 | 27 | 28 | 29 | 30 | 31 |
|---|---|---|---|---|---|---|---|---|
| Reagents | | | | | | | | |
| $H_2O_2$, g/100g m.s. | 2 | 2 | 2 | 2 | 2 | 2 | 2 | 2 |
| NaOH, g/100g m.s. | 1.5 | 1.5 | 1.5 | 1.5 | 1.5 | 1.5 | 1.5 | 1.5 |

TABLE II-continued

| Test No. | 24 | 25 | 26 | 27 | 28 | 29 | 30 | 31 |
|---|---|---|---|---|---|---|---|---|
| $MgSO_4$, $7H_2O$ g/100g m.s. | 0.1 | 0.1 | 0.1 | 0.1 | 0.1 | 0.1 | 0.1 | 0.1 |
| "Clarene S", g/100g m.s. | 0.15 | 0.15 | 0.15 | 0.15 | 0.15 | 0.15 | 0.15 | 0.15 |
| $CaCl_2$, g/l | — | — | — | — | — | — | — | 1 |
| $SrCl_2$, g/l | — | — | — | 1 | 0.5 | 0.5 | 0.1 | — |
| $BaCl_2$, g/l | — | — | 1 | — | — | — | — | — |
| Acidification of the pulp by HCl | | | | | x | x | x | |
| $H_2SO_4$ | x | x | x | x | | | | x |
| Final whiteness °ISO | 78.9 | 78.0 | 81.6 | 81.5 | 81.5 | 81.6 | 79.6 | 77.6 |

m.s.: dry cellulose materials

The second series of tests was carried out on pulp whose original whiteness was 69° ISO, viscosity 12.5 mPa.s and mean degree of polymerisation 990.

After acidification of the pulp by means of sulphuric acid, a sample was taken for determination of the level of whiteness and the level of viscosity according to standard TAPPI-T-230. The degree of polymerisation was calculated from the levels of viscosity according to the ratios given in standard SCAN-C-15 (1962).

The operating conditions and results obtained are shown in Table III below. Tests 32 and 33 were carried out by way of comparison.

TABLE III

| TEST No. | 32 | 33 | 34 | 35 | 36 | 37 | 38 |
|---|---|---|---|---|---|---|---|
| Reagents | | | | | | | |
| $H_2O_2$, g/100g m.s. | 2 | 2 | 2 | 2 | 2 | 2 | 2 |
| NaOH, g/100g m.s. | 1.5 | 1.5 | 1.5 | 1.5 | 1.5 | 1.5 | 1.5 |

TABLE III-continued

| TEST No. | 32 | 33 | 34 | 35 | 36 | 37 | 38 |
|---|---|---|---|---|---|---|---|
| $MgSO_4$, $7H_2O$ g/100g m.s. | 0.1 | 0.1 | 0.1 | 0.1 | 0.1 | 0.1 | 0.1 |
| "Dequest 2066", g/100g m.s. | — | 0.15 | 0.15 | 0.15 | 0.15 | 0.15 | 0.15 |
| $CaCl_2$, g/l | — | — | 0.25 | 0.50 | 1.0 | — | — |
| $SrCl_2$, g/l | — | — | — | — | — | 0.5 | — |
| $BaCl_2$, g/l | — | — | — | — | — | — | 0.5 |
| Results | | | | | | | |
| Viscosity, mPa.s. | 10.8 | 11.6 | 11.6 | 11.6 | 11.6 | 11.7 | 11.7 |
| Mean degree of polymerisation | 915 | 955 | 955 | 955 | 955 | 960 | 960 |
| Drop in mean degree of polymerisation | 7.6 | 3.5 | 3.5 | 3.5 | 3.5 | 3.0 | 3.0 |
| Final whiteness, °ISO | 77.7 | 77.6 | 79.4 | 80.5 | 81.6 | 79.7 | 79.6 |

m.s.: DRY CELLULOSE MATERIALS

The amount of DEQUEST used is expressed as active materials.

We claim:

1. Process for inhibiting the corrosion of equipment made of titanium or of alloys containing titanium by an aqueous solution containing a peroxy compound, comprising inhibiting the corrosion by having the solution contain calcium, strontium or barium ions.

2. Process according to claim 1, wherein the ions are supplied to the solution in the form of a compound selected from the acetates, carbonates and bicarbonates, nitrates, sulphates, hydroxides, chlorates, hypochlorites and halides.

3. Process according to claim 1 or 2, wherein said ions are present in a quantity of between 0.001 and 0.1 gramme atoms per liter.

4. Process according to claim 1 or 2, wherein the peroxy compound is hydrogen peroxide or sodium peroxide.

5. Process according to claim 1 or 2, wherein the solution also contains a compound of basic character.

6. Process according to claim 5, wherein the compound of basic character is a hydroxide of sodium or potassium.

7. Process according to claim 1 or 2, wherein the solution is applied in the bleaching of cellulose materials.

8. Process according to claim 7, wherein the solution is applied in the dynamic bleaching of paper pulps.

9. Process according to claim 8, wherein the solution contains from 0.1 to 20% peroxy compound, from 0 to 20% compound of basic character and from 0 to 5% additives with respect to the weight of dry cellulose materials.

10. Process according to claim 9, wherein the solution contains additives suitable for the stabilisation of peroxy compounds.

* * * * *